US009814265B2

(12) United States Patent
Rinker et al.

(10) Patent No.: US 9,814,265 B2
(45) Date of Patent: Nov. 14, 2017

(54) PERMEABLE ELECTRIC THERMAL RESISTOR FOIL FOR VAPORIZING FLUIDS FROM SINGLE-USE MOUTHPIECES WITH VAPORIZER MEMBRANES

(71) Applicant: PHILIP MORRIS PRODUCTS S.A., Neuchatel (CH)

(72) Inventors: Arno Rinker, Hamburg (DE); Philipp Litzenberger, Hamburg (DE)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 854 days.

(21) Appl. No.: 14/344,026

(22) PCT Filed: Sep. 27, 2012

(86) PCT No.: PCT/EP2012/069135
§ 371 (c)(1),
(2) Date: Mar. 10, 2014

(87) PCT Pub. No.: WO2013/045582
PCT Pub. Date: Apr. 4, 2013

(65) Prior Publication Data

US 2014/0305454 A1 Oct. 16, 2014

(30) Foreign Application Priority Data

Sep. 28, 2011 (EP) ..... 11183197

(51) Int. Cl.
*A24F 47/00* (2006.01)
*H05B 3/26* (2006.01)

(52) U.S. Cl.
CPC ..... *A24F 47/008* (2013.01); *H05B 3/26* (2013.01); *H05B 2203/013* (2013.01)

(58) Field of Classification Search
CPC ..... A24F 47/00; A24F 47/008; H05B 3/26; H05B 2203/013
(Continued)

(56) References Cited

U.S. PATENT DOCUMENTS 5,388,594 A 2/1995 Counts et al.
5,649,554 A 7/1997 Sprinkel et al.
(Continued)

FOREIGN PATENT DOCUMENTS

CA 2 502 171 C 1/2013
CN 2244307 Y 1/1997
(Continued)

OTHER PUBLICATIONS

Examination Report issued Jun. 27, 2016 in the Gulf Cooperation Council Patent Application No. GC 2012-22390.
(Continued)

*Primary Examiner* — Alison L Hindenlang
*Assistant Examiner* — Mohamed K Ahmed Ali
(74) *Attorney, Agent, or Firm* — Oblon, McClelland, Maier & Neustadt, L.L.P.

(57) ABSTRACT

A vaporizer device for vaporizing substances is provided, containing active and/or aroma materials, including a mouthpiece with a fluid inlet and a fluid outlet, and including: a heating device with a thermal resistor being a metallic foil or a thin sheet configured as a dual coil and/or sinuous line with two ends and dimensions of the cross-section of a cigarette or a small cigar, wherein the interspaces of the dual coil and/or sinuous line allow fluid flow therethrough, contact tabs are connected to respective opposed ends of the dual coil and/or sinuous line and are not in direct contact with one another, and at least one permeable and wettable vaporizer membrane in large-area contact with the thermal resistor, wherein the thermal resistor and the at least one
(Continued)

vaporizer membrane are arranged orthogonally or at an angle to the direction of the fluids passing through the mouthpiece.

17 Claims, 2 Drawing Sheets

(58) Field of Classification Search
USPC ..... 128/202.21, 17; 131/329; 338/294
See application file for complete search history.

(56) References Cited

U.S. PATENT DOCUMENTS

| | | | | |
|---|---|---|---|---|
| 5,750,964 | A | 5/1998 | Counts et al. | |
| 2002/0078951 | A1* | 6/2002 | Nichols ..... | A61M 11/041 128/200.22 |
| 2011/0005535 | A1 | 1/2011 | Xiu | |
| 2011/0155153 | A1 | 6/2011 | Thorens et al. | |
| 2012/0193343 | A1 | 8/2012 | Johnson | |

FOREIGN PATENT DOCUMENTS

| | | | |
|---|---|---|---|
| CN | 1575673 | A | 2/2005 |
| CN | 101262786 | A | 9/2008 |
| DE | 1 565 641 | | 2/1970 |
| EP | 013046 | B1 | 2/2010 |
| EP | 2 260 733 | | 12/2010 |
| EP | 2 359 705 | A1 | 8/2011 |
| JP | 7-184627 | A | 7/1995 |
| JP | 2012-533313 | A | 12/2012 |
| JP | 2013-516159 | A | 5/2013 |
| RU | 2 360 583 | C1 | 7/2009 |
| WO | WO 2007/042941 | A2 | 4/2007 |
| WO | WO 2009/134164 | A1 | 11/2009 |
| WO | 2012 006722 | | 1/2012 |

OTHER PUBLICATIONS

International Search Report Issued Mar. 28, 2013 in PCT/EP12/069135 Filed Sep. 27, 2012.

Office Action issued Sep. 21, 2015 in Kazak Patent Application No. 2014/1579.1 (with English language translation).

Korean Office Action issued Apr. 14, 2016 in Patent Application No. 10-2014-7003526 (with English translation).

Combined Office Action and Search Report issued Sep. 15, 2015 in Chinese Patent Application No. 201280045111.3 (with English language translation).

German language International Preliminary Report on Patentability (IPRP) with English translation issued in International application No. PCT/EP2012/069135 (18 pages).

* cited by examiner

PERMEABLE ELECTRIC THERMAL RESISTOR FOIL FOR VAPORIZING FLUIDS FROM SINGLE-USE MOUTHPIECES WITH VAPORIZER MEMBRANES

CROSS REFERENCE TO RELATED APPLICATION

This application is a national phase application based on PCT/EP2012/069135, filed on Sep. 27, 2012.

TECHNICAL FIELD

The present invention relates in general to a device for optimized smoke-free inhalation of nicotine and/or additives with electronic cigarettes.

GENERAL INTRODUCTION

When a conventional cigarette is smoked, tobacco is burned and the smoke arising during this combustion is inhaled (mainstream smoke) or discharged into the surrounding environment (sidestream smoke).

Mainstream smoke is the crucial factor in damaging the health of the consumer, but is what gives him/her the desired pleasure. Sidestream smoke is the crucial factor in damaging the health of passive smokers and is desired neither by the passive smokers nor by the consumer.

Over 4800 different substances have been identified in cigarette smoke, of which around 70 are demonstrably carcinogenic.

The aim of methods and devices based thereon for smoke-free inhalation of nicotine and/or additives is to offer the consumer a substitute for the conventional cigarette which causes significantly less harm to the consumer and third parties, preferably no harm at all to the consumer and third parties, while however retaining the consumer experience of a conventional cigarette.

PRIOR ART

At present, so-called e-cigarettes (electronic cigarettes) establish themselves on the market as a substitute for conventional cigarettes. Among different approaches, the approach described hereinbelow has become accepted in view of its comparatively easy technical realizability in combination with its convincing functionality (vaporization rate, nicotine output).

Patent DE69017371T2, which dates back to 1990, describes a smoking article comprising a flavor-generating medium, an electric heating element and means for applying electrical energy, the flavor-generating medium being releasable from the electric heating element, characterized in that the electric heating element is in thermal contact with the flavor-generating medium, that the means for applying electrical energy applies electrical energy to the heating element thereby causing the heating element to heat said flavor-generating medium and to release flavor components, and that a control means is provided for controlling the amount of electrical energy applied by the means for applying electrical energy.

This basic principle has been developed to marketability and optimized in the last two decades, as described hereinbelow.

A fluid to be vaporized is supplied from a reservoir to a small heating coil due to the capillary effect of a metal braid or a glass fiber wick. The heating coil is normally activated by a vacuum switch or a vacuum governor when a puff is taken from the electronic cigarette, whereby the fluid (liquid) evaporates.

The main components of the electronic cigarette are the following ones: the battery unit with vacuum switch or vacuum governor and LED for optically simulating the glowing end of a lit cigarette, the vaporizer unit (atomizer) with heating coil and capillaries as well as the mouthpiece with the fluid reservoir.

The three components are normally cylindrical and, when assembled, their shape imitates a cigarette. In the interior of these components a flow channel is formed, which extends through all three components. When a puff is taken from the electronic cigarette, an air current is sucked into the battery unit, whereby the vacuum switch or vacuum governor is operated. This has the effect that the heating coil provided in the downstream vaporizer unit is activated.

The helical heating coil is wound around a fiber strand, which, through capillaries, is connected directly or via a metal braid to a fluid reservoir located downstream in the mouthpiece and which is impregnated with fluid, said fiber strand being arranged orthogonally to the flow direction. Due to the activation of the heating coil, fluid is vaporized and transferred to the air current.

The reservoir itself, which is filled with the fluid to be vaporized, is not directly exposed to the flow in the flow channel, but is arranged in a lateral pocket of the mouthpiece. The fiber strand is thus supplied through the capillaries of the metal braid and the glass fiber strand, without non-vaporized fluid from the reservoir arriving inevitably in the consumer's mouth. The reservoir normally consists of a small piece of non-woven fabric.

In addition to the reservoir, the mouthpiece only comprises a flow channel and the air outlet in the form of a small hole in the end face thereof. The air current, which has added thereto the vaporized fluid, flows into the consumer's oral cavity through said air outlet.

The battery unit and the vaporizer unit are releasably connected to one another via a thread. The end face of the thread and the threaded surface are electrically conductive and insulated from one another, so that, when the battery unit and the vaporizer unit have been connected via the thread, an electric current can flow between them and the heating coil can be supplied by the battery when the vacuum switch or vacuum governor has been activated. In the demounted condition, the battery unit can be connected to a battery charger via the same thread.

The mouthpiece is attached via a cylindrical flange to the vaporizer unit end located opposite the thread. The reservoir in the mouthpiece comes thus into contact with the metal braid of the vaporizer unit and the transport of fluid from the reservoir into the interior of the heating coil is initiated.

A big disadvantage of this embodiment of electronic cigarettes having a separate, reusable vaporizer unit is that the vaporizer unit will get increasingly contaminated during its service life. Since many reservoirs comprising each 200 puffs are normally consumed before the vaporizer unit is exchanged and since the capillaries are not cleaned, there is the potential risk of vaporizing microorganisms and undesired harmful substances. A vaporizer unit can be used up to 6 months.

Another drawback of the increasing contamination of the vaporizer unit is the potential loss of quality during the consumption period. For example, when a mouthpiece is being exchanged, the fluid to be vaporized contained in the new mouthpiece will mix with the fluid residues that are still contained in the capillaries. This is particularly disadvantageous, if the consumer wants to consume different aromas with one vaporizer.

Another disadvantageous aspect is that fluid leaks out when the mouthpieces attached to the vaporizer are being exchanged, whereby the consumer's skin often comes into contact with a fluid containing nicotine. Depending on the respective nicotine content, the skin contact may lead to minor poisoning.

Last but not least, this tripartite design has the drawback that the resultant length can hardly be reduced still further, and this is adverse to the aim of not exceeding the overall length of a king size cigarette to a substantial extent.

The above-mentioned drawbacks are partially remedied when the vaporizer unit is integrated in the mouthpiece, since the escape of fluid and the resultant skin contact risk can be avoided and the aim of limiting the overall length approximately to that of a king size cigarette can be achieved more easily.

However, the threaded connection, which, together with the vaporizer, has been transferred to the mouthpiece, now proves to be disadvantageous, and, in addition to the fact that a threaded connection is inconvenient to handle, this also leads to waste disposal problems in view of the comparatively thick metal wall in the area of the thread and the now given single-use character of the combined product, especially since it is a mass production product, whereby the use of an excessive amount of material increases exponentially.

For both the above-mentioned variants, i.e. the variant comprising a separate vaporizer as well as the variant having the vaporizer integrated in the mouthpiece, the refillability of the respective reservoirs as well as the resultant refilling practice which has already been widely adopted constitute a big problem in view of the potential risks that may be entailed by fluids containing nicotine. Refill bottles may contain an amount of nicotine that may be lethal to children.

In addition, the alleged hygienic advantage of the systems comprising a vaporizer that is integrated in the mouthpiece is nullified, since these systems are also often refilled in practice, although they frequently use, instead of the glass fiber capillaries, fibers as capillaries, which carbonize when they are used for a prolonged period of time.

Finally, a big disadvantage of the systems comprising a vaporizer integrated in the mouthpiece is to be seen in the impossibility of producing this product, which is a mass product, on fast-running machines in view of the components used, e.g. the screw flange which is produced by a metal-cutting process and whose outer ring and whose end face are electrically separated, and the hardly automatable mounting, e.g. the mounting of the heating coil which is welded to the screw flange through wires and of the glass fiber strand or natural fiber strand conducted through the heating coil.

WO2011/009920 describes a method for volatilizing active and/or aroma materials for the purpose of releasing an inhalable aerosol, wherein a fluid acted upon by thermal energy flows through a flow channel in a preferably cylindrical hollow body and wherein the fluid in this flow channel entirely or in part flows through at least one vaporizer membrane, wherein the at least one vaporizer membrane has been and/or is wetted with a substance containing active and/or aroma materials to be vaporized and wherein the fluid additionally containing thermal energy, i.e. acted upon by thermal energy, vaporizes this substance or these substances on flowing through the vaporizer membrane and supplies it or them to the fluid stream.

The last mentioned method and the device based thereon allow an optimum vaporization of substances containing active and/or aroma materials, without the above-mentioned drawbacks, such as hygienic problems, high manufacturing costs resulting from the particular design and excessively long consumption time, of the electric systems available on the market, i.e. said device is, in principle, ideal for use as a mouthpiece of a smoke-free cigarette, but said method makes use of a fluid stream which has already been acted upon by heat due to the combustion of liquefied gas and which is provided by means of the process described in WO2008/113420, whereas it is not possible to accomplish a purely electrical generation of an adequately hot fluid stream in the space available in a cigarette or a small cigar because there is not enough space for a heat exchanger.

WO2008/113420 describes a method for volatilizing active and/or aroma substances for the purpose of releasing an inhalable aerosol, wherein combustion gases of a flammable gas, which is preferably combusted with an excess of air, are passed partially or entirely, optionally mixed with ambient air, through an active and/or aroma substance reservoir and wherein a desired temperature is selectable by the proportion of combustion gases and optionally by the mixing ratio of said combustion gases with ambient air.

An essential disadvantage of this method is the use of liquefied gas, which has the effect that, due to the supposed explosion risk in the immediate vicinity of the consumer's face, even though this risk is only hypothetical and can be governed by a fail-safe design, there will be security concerns on the part of potential customers on the one hand and a high probability that products based on this principle will not be allowed aboard an aircraft on the other.

OBJECT OF THE INVENTION

It is therefore an object of the present invention to provide a device for electronic cigarettes which guarantees a vaporization of nicotine and/or additives without reusable components that come into contact with the fluid to be vaporized, and to preferably accomplish at the same time a substantial reduction of costs and ecological damage by reducing the amount of material used and by optimizing machine processability.

GENERAL DESCRIPTION OF THE INVENTION

According to the present invention, this object is achieved by a heating device of the type described in claim 1 and a vaporizer device used for vaporizing fluids from permeable vaporizer membranes (similar to those described in WO2011/009920) and including such a heating device, said heating device comprising:

- a permeable thermal resistor foil configured as a dual coil and/or sinuous line with two ends and dimensions of the cross-section of a cigarette or a small cigar, wherein the interspaces of the dual coil and/or sinuous line of the thermal resistor (1) are open (permeable) and allow thus a flow of fluid therethrough.
- at least two electric contacts (contact tabs) which are fixedly connected to the respective opposed end of the thermal resistor foil on one side thereof and which are exposed on the other side thereof, which allows them to be releasably connected to a controlled or regulated voltage source, the thermal resistor foil and the electric contacts being preferably made of one piece.

In the sense of the present invention, the term permeable means for the thermal resistor foil as well as for the vaporizer membranes that they allow gas to pass therethrough (permeable to gas) in the direction of their surface normal.

According to the present invention, a permeable thermal resistor foil consists of an electrically conductive foil, which is preferably subjected to punching or laser cutting so as to obtain a dual coil or a sinuous line shape or a combination of dual coil and sinuous line shapes. In case of a combination of dual coil and sinuous line shapes the thermal resistor may include, for example, two partial areas with sinuous line shapes having an interposed partial area in the form of a dual coil, or with a dual coil having a central partial area in the form of a sinuous line. Other combinations with additional, different partial areas are possible as well.

The thermal resistor foil according to the invention consists of an electrically conductive material, preferably an aluminum or high-quality steel alloy, and more preferably of a food-safe pure aluminum, an AlMn alloy or stainless steel, such as X5CrNi18-10.

The wall thickness of a permeable thermal resistor foil according to the present invention is between 0.01 mm and 0.2 mm, preferably, however, it is between 0.02 mm and 0.08 mm.

Depending on the electric conductivity of the fluid to be vaporized, the thermal resistor foil can be coated with a heat-resistant and electrically insulating plastic layer, preferably a layer of polyimide, micanite or silicone, thus avoiding a short circuit if the electric resistance of the fluid to be vaporized should be too low in comparison with the resistance of the thermal resistor foil. Micanite in the sense of the present invention generally refers to artificial mica, i.e. a composite material comprising broken bits of mica (broken bits of layered silicate) and artificial resin as a matrix system. Exemplary products: flexible micanite FLM M & P (consisting of at least 92% of muscovite or, alternatively, phlogopite, impregnated with a high temperature resistant silicone binding agent), flexible micanite FLM 521 P, etc.

Such a heating device can be used e.g. as an electric thermal resistor in a vaporizer device for vaporizing substances containing active and/or aroma materials, e.g. in a disposable, single-use mouthpiece for an electronic cigarette. By simply attaching the heating device to a battery unit including a vacuum switch or vacuum governor, the electronic cigarette will be ready for use. When the current circuit is closed by the vacuum switch or vacuum governor, the thermal resistor foil will heat and vaporize the fluid from the vaporizer membrane.

Another aspect therefore concerns a vaporizer device for vaporizing substances containing active and/or aroma materials, preferably configured as a mouthpiece in the form of a hollow cylinder with a fluid inlet and a fluid outlet. The vaporizer device comprises a heating device of the type described here and at least one vaporizer membrane which is in large-area contact with the thermal resistor. The vaporizer membrane is also permeable to flowing fluids and is either wetted or can be wetted with a substance containing active and/or aroma materials to be vaporized. The thermal resistor and the vaporizer membrane(s) are preferably arranged orthogonally or at an angle to the direction of the fluids passing through the mouthpiece.

The above-described structural design of the vaporizer device achieves not only a very high vaporizing efficiency but also the highest possible degree of vaporization uniformity due to fact that the invention provides the largest possible contact area between the thermal resistor foil and the vaporizer membrane or vaporizer membranes.

Another essential advantage of the invention is that, by varying the geometrical configuration of the thermal resistor foil, e.g. by varying the number of coil windings, the width of the windings and/or the wall thickness of the foil or of the thin sheet, the power of the thermal resistor can be adapted in the best possible way to various substances to be vaporized, which contain different materials.

By choosing adequate materials as well as adequate geometrical parameters of the thermal resistor foil, the electric resistance of the thermal resistor foil can be adjusted in the range of 1-10Ω (Ohm), whereby a spectrum of 0.1-13.7 Watt heating power in the cross-section of a cigarette mouthpiece can be covered with a possible nominal voltage of an attached battery unit of 1.2 V (NiCd)-3.7 V (Li-ion).

Another important advantage of the invention is that, by providing a local constriction (narrowing), a safety fuse can be integrated in the contour of the thermal resistor foil. When the fluid has been consumed, this safety fuse will be thermally destroyed due to the then no longer existing cooling, and the mouthpiece will be rendered useless, whereby a single-use mouthpiece with a specific consumption time of 5-20 puffs per 20-50 ml, preferably, however, with 8-12 puffs per 35 ml, can be obtained in a particularly easy manner.

According to a further embodiment, the vaporizer device additionally comprises a flange for releasably connecting a controlled or regulated electric voltage source by the electric poles, the contact tabs, which are connected to the respective opposed end of the dual coil and/or sinuous line of the thermal resistor, not being in direct contact with one another, i.e. they are only in contact with one another via the thermal resistor. These contact tabs are adapted to be connected via the flange to the electric poles of a controlled or regulated electric voltage source.

Preferably, an insulation foil covers the contact tabs towards a flange area on the inner side of the hollow cylinder of the mouthpiece. The insulation foil includes, preferably in the region of said flange area, at least two axially displaced contact openings, said contact openings being preferably configured such that they are axially located in one plane and expose each only one contact tab. The poles of a controlled or regulated electric voltage source are e.g. two axially displaced rings, and, in the connected condition of the mouthpiece and the voltage source, a respective pole of the voltage source is connected via the contact openings to the contact tabs and via the contact tabs to a respective end of the dual coil and/or the sinuous line of the thermal resistor.

According to a further embodiment, the contact tabs and/or the flange area preferably include at least one locating groove and/or locating projection, said locating groove and/or locating projection having a complementary counterpart configured as at least one locating projection and/or locating groove on the controlled or regulated electric voltage source. In the connected condition of the mouthpiece and the voltage source, a respective pole of the voltage source is connected to the contact tabs and via the contact tabs to a respective end of the dual coil and/or the sinuous line of the thermal resistor.

According to another preferred embodiment, at least one pointed and/or sharp-edged opening tab consisting of a metallic foil or a thin sheet, preferably (but not coercively) of the same metallic foil, respectively same thin sheet, as the thermal resistor, extends, with its pointed and/or sharp-edged side first, from the thermal resistor axially in the direction of the flange of the mouthpiece and is implemented such that, when the mouthpiece and the voltage source are being connected, a sealing foil of a storage cartridge between the thermal resistor and the flange is punctured and/or cut open by said opening tab, said storage cartridge being filled with a substance containing active and/or aroma materials.

Hence, the present invention not only allows the provision of a combination of storage and vaporization functions in a single-use mouthpiece which, in comparison with known devices of this type, provides a more efficient vaporization and a reduction of the amount of resources consumed, but it also offers a precisely defined, temporally limited consumer experience.

Due to the fact that the above-described thermal resistor foil is preferably produced by means of punching or die bending, this production can excellently be integrated in a fast-running manufacturing process, and this constitutes another essential advantage of the present invention.

BRIEF DESCRIPTION OF THE FIGURES

In the following, advantages and advantageous further developments of the invention will be described making reference to the figures enclosed.

a) A dual coil 101 as a thermal resistor 1.

b) A sinuous line 102 as a thermal resistor 1 having additionally integrated therein a safety fuse 12.

Figure 1:
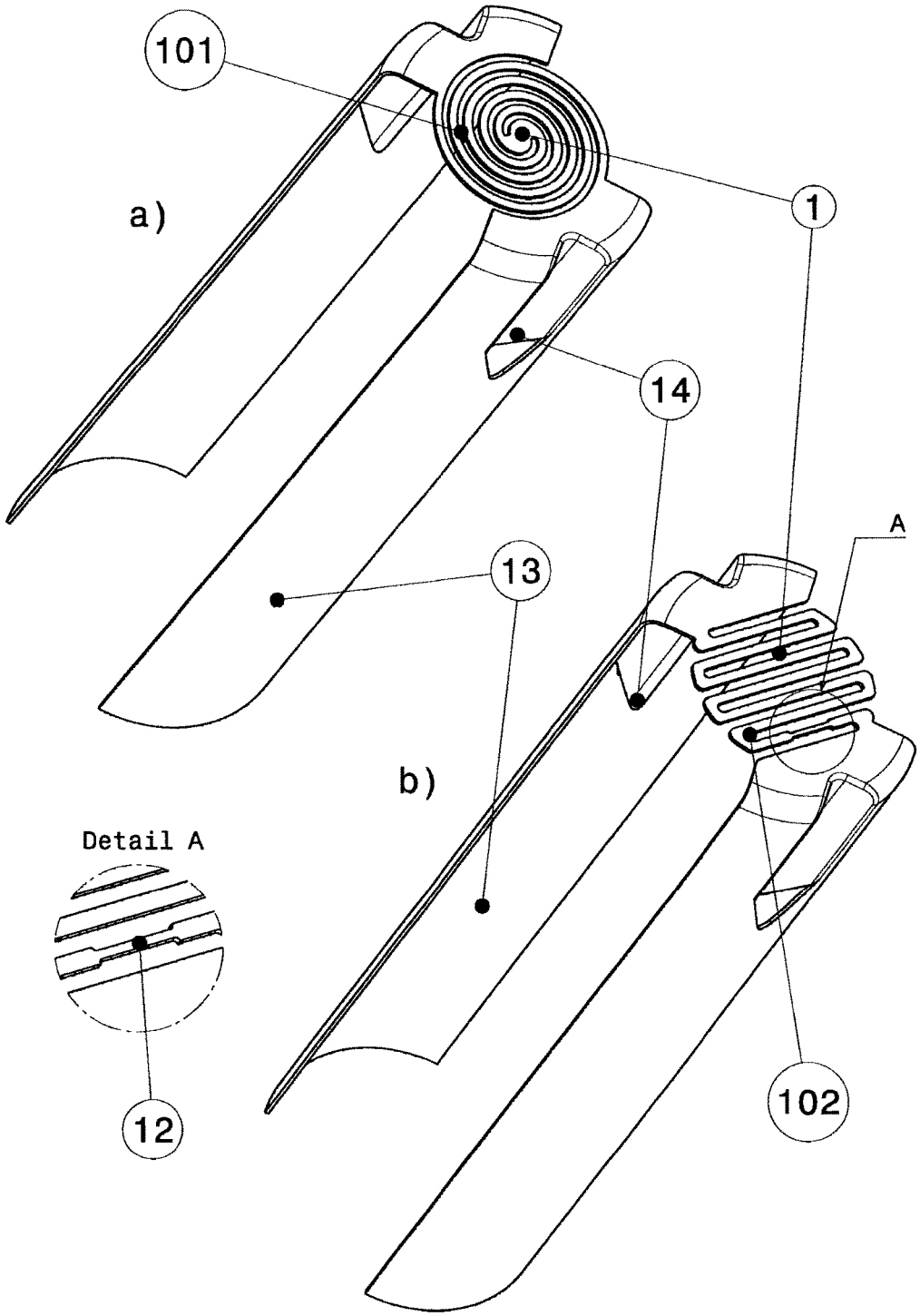
FIG. 1 shows two variants of a preferred embodiment of the heating device described in the present invention, in the case of which the thermal resistor 1, the contact tabs 13 and two opening tabs 14 are produced from a single piece of metal foil.
Figure 2:
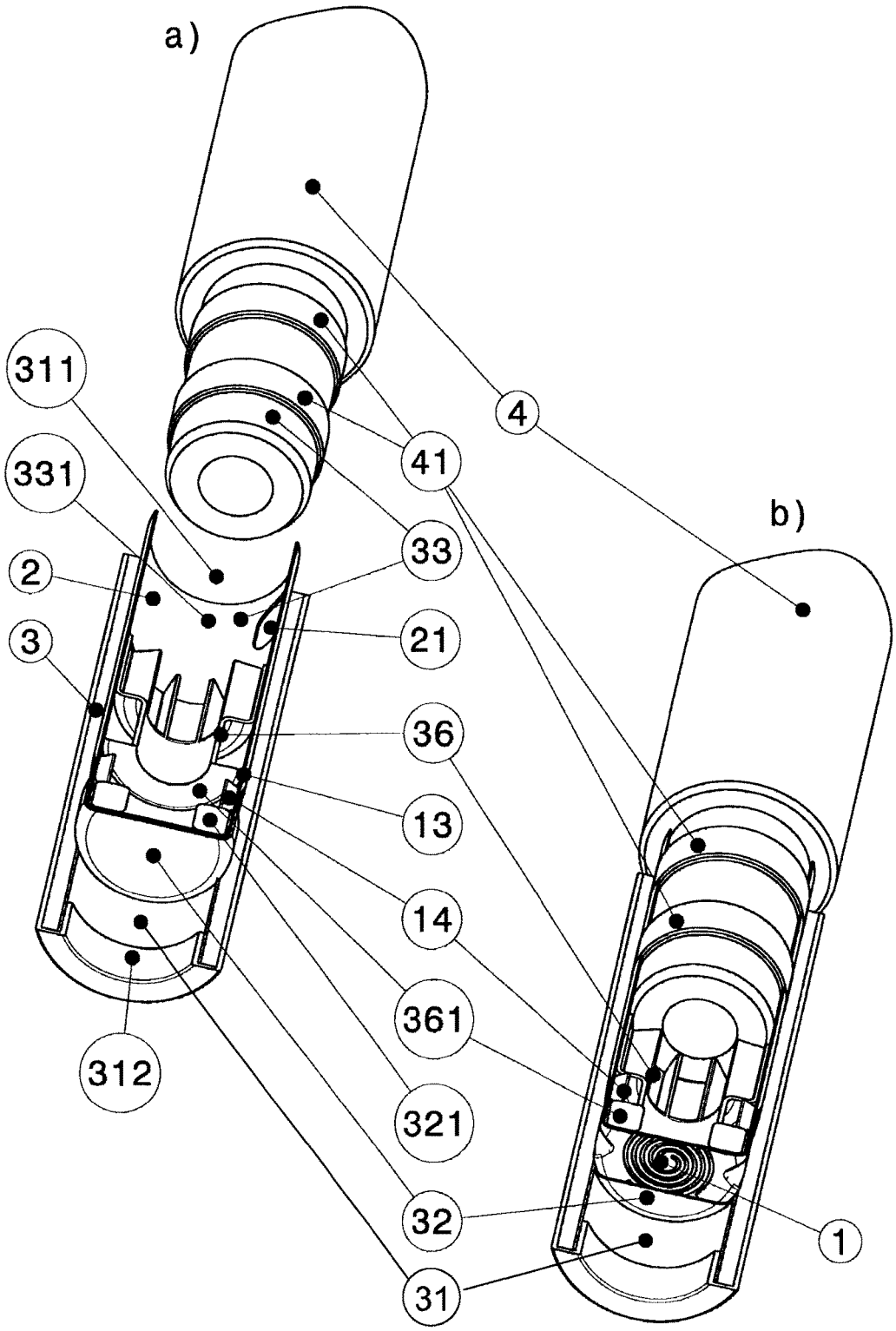

FIG. 2 shows how a mouthpiece 3 according to a preferred embodiment of the present invention is connected to a voltage source 4, the two annular poles 41 of the voltage source 4 coming into contact with the contact tabs 13 via the contact openings 21 provided in the insulation foil 2, whereby the thermal resistor 1 can be supplied with current, the storage cartridge 36 being axially displaced within the hollow cylinder 31 towards the buffer storage 321 through the end face of the flange 33 of the voltage source 4, whereby the sealing foil 361 of the storage cartridge 36 is torn open by the opening tabs 14, whereupon the substance containing active and/or aroma materials flows into the buffer storage 321 and from there into the vaporizer membranes 32.

a) Mouthpiece in inactive storage condition with intact sealing foil 361 and storage cartridge 36 at the original position, voltage source 4 not yet attached.

b) Mouthpiece in activated condition of use with destroyed sealing foil 361 and storage cartridge 36 at the final position, with attached voltage source 4.

DESCRIPTION OF A PREFERRED EMBODIMENT OF THE INVENTION

According to a preferred embodiment of the invention a device according to the present invention is used as a thermal resistor 1, e.g. in a device described in WO2011/0099 20, i.e. a device according to the present invention is combined with a device in which a fluid flows through at least one vaporizer membrane 32 in a flow channel 31, wherein the at least one vaporizer membrane 32 has been and/or is wetted with a substance containing active and/or aroma materials to be vaporized, the device according to the present invention supplying thermal energy to the substance containing active and/or aroma materials, whereby this substance is vaporized and supplied to the fluid stream.

According to this embodiment, the device according to the present invention comprises a hollow cylinder 31 consisting of a plastic film, a paperboard and cover paper, said cover paper being wound around the outer surface of the paperboard and corresponding preferably to the so-called cork paper of cigarette filters and the paperboard being coated with a plastic film on the inner surface thereof, a permeable thermal resistor foil 1 in the form of a dual coil 101 punched from an aluminium foil, the permeable thermal resistor foil 1 being coated with a insulating layer 11 of polyimide, two electric contacts 13 in the form of contact tabs 13 on the thermal resistor foil 1, which extend longitudinally within the hollow cylinder 31 along the inner surface thereof from the thermal resistor foil 1 up to and into the flange 33, each of the contacts having a cross-sectional shape corresponding to a quarter circle, two permeable vaporizer membranes 32 which are arranged such that, in axial the direction, one vaporizer membrane 32 is disposed upstream of and the other vaporizer membrane 32 is disposed downstream of the permeable thermal resistor foil 1 to be in direct large-area contact therewith, part of said vaporizer membranes being in direct contact with one another, a vaporizer buffer store 321 in the form of a ring of an absorptive non-woven fabric across which the vaporizer membranes 32 are spanned like a drumhead, two opening tabs 14 in the form of spikes projecting from the contact tabs 13 into the flow channel 31 and extending axially from the thermal resistor foil 1 towards the flange 33, an insulation foil 2 extending longitudinally within the hollow cylinder 31 and within the contact tabs 13 along the inner surface thereof from the thermal resistor foil 1 up to and into the flange 33 with two axially displaced contact openings 21, the inner surface of the insulation foil 2 and the contact tab areas exposed through the contact openings 21 representing the flange area 331 of the flange 33 located on the side of the mouthpiece, an axially movable annular storage cartridge 36 within the insulation foil 2 of the hollow cylinder 31, said storage cartridge 36 containing a substance which contains active and/or aroma materials and being sealed by a sealing foil 361, and said sealing foil 361 being destroyed when the storage cartridge 36 is moved towards the thermal resistor foil 1 to such an extent that the opening tabs 14 penetrate the sealing foil 361.

The above-described preferred embodiment of the present invention is used with a rod-shaped voltage source 4 with two annular poles 41 on the outer surface of the voltage source-side flange 33, the voltage source having an air discharge opening which is located on the end face of the flange 33 and through which the fluid stream flows into the mouthpiece 3, the flow channel of the voltage source having provided therein a vacuum governor which, in the connected condition, controls the flow of current from the voltage source via the annular poles 41 through the contact tabs 13 and the thermal resistor foil 1 of the mouthpiece 3.

TABLE 1 reference list

| No. | general designation | specific designation |
|---|---|---|
| 1 | thermal resistor | permeable thermal resistor foil |
| 101 | dual coil | |
| 102 | sinuous line | |
| 11 | insulating layer | electrically insulating plastic layer |
| 12 | safety fuse | |
| 13 | contact tab | electric contact |
| 14 | opening tab | |

TABLE 1-continued

| reference list | | |
|---|---|---|
| No. | general designation | specific designation |
| 2 | insulation foil | |
| 21 | contact opening | |
| 3 | mouthpiece | |
| 31 | hollow cylinder | flow channel |
| 311 | fluid inlet | |
| 312 | fluid outlet | |
| 313 | flow channel | |
| 32 | vaporizer membrane | permeable vaporizer membrane |
| 321 | buffer store | vaporizer buffer store |
| 33 | flange | |
| 331 | flange area | |
| 34 | locating groove | |
| 35 | locating projection | |
| 36 | storage cartridge | |
| 361 | sealing foil | |
| 4 | voltage source | battery unit with vacuum switch |
| 41 | pole | electric pole |

The invention claimed is:

1. A vaporizer device for vaporizing a substance containing at least one active and/or aroma material, comprising:

a mouthpiece, having at least one fluid inlet and at least one fluid outlet; and a heating device, configured to be connected to the mouthpiece, comprising:

a thermal resistor comprising a metallic foil or a thin sheet in a shape of a dual coil and/or sinuous line, having two ends and dimensions substantially the same as a cross-section of a cigarette or a cigar, wherein interspaces of the shape are configured to allow a flow of fluid therethrough;

at least one contact tab including a first contact tab and a second contact tab being connected to respective opposed ends of the dual coil and/or sinuous line of the thermal resistor, the first contact tab and the second contact tab not being in direct contact with each other; and at least one vaporizer membrane disposed in contact with the thermal resistor and being permeable to the flow of fluid, and which is wetted or can be wetted with the substance containing the at least one active and/or aroma material, wherein the thermal resistor and the at least one vaporizer membrane are arranged orthogonally or at an angle to a direction of the flow of fluid in the mouthpiece.

2. The vaporizer device according to claim 1, wherein the mouthpiece has a shape of a hollow cylinder.

3. The vaporizer device according to claim 1, wherein the thermal resistor and the at least one contact tab are formed of at least one piece of the metallic foil or the thin sheet.

4. The vaporizer device according to claim 1, wherein the thermal resistor and the at least one contact tab are formed of different materials.

5. The vaporizer device according claim 1, wherein the thermal resistor and the at least one contact tab are formed of a same material.

6. The vaporizer device according to claim 1, further comprising a storage cartridge configured to be filled with the substance containing the at least one active and/or aroma material, wherein the heating device further comprises at least one pointed and/or sharp-edged opening tab configured to puncture or cut open the storage cartridge.

7. The vaporizer device according to claim 6, wherein the thermal resistor, the at least one contact tab, and the at least one opening tab are formed of at least one piece of the metallic foil or the thin sheet.

8. The vaporizer device according to claim 1, wherein the metallic foil or the thin sheet, or the metallic foil and the thin sheet, are aluminum, an aluminum-manganese alloy, or a stainless steel, or a combination thereof.

9. The vaporizer device according to claim 1, wherein the thermal resistor is coated with an insulating layer.

10. The vaporizer device according to claim 9, wherein the insulating layer is polyimide, micanite, or silicone, or a combination thereof.

11. The vaporizer device according to claim 1, wherein the thermal resistor includes a fuse formed of at least one constricted region in the dual coil and/or sinuous line.

12. The vaporizer device according to claim 1, further comprising:

a voltage source having two poles and configured to be removably connected to the mouthpiece and the heating device; and a flange disposed on an inner surface of the mouthpiece and partially extending beyond an edge of the inner surface, the flange being configured to releasably connect the two poles to the heater device, wherein, via the flange, the first contact tab is configured to electrically connect to one of the two poles and the second contact tab is configured to electrically connect to the other of the two poles.

13. The vaporizer device according to claim 12, wherein the voltage source is a controlled or a regulated voltage source.

14. The vaporizer device according to claim 12, wherein the mouthpiece further comprises a storage cartridge filled with the substance containing the at least one active and/or aroma material, wherein the heating device further comprises at least one pointed and/or sharp-edged opening tab formed of the metallic foil or the thin sheet and being configured to puncture or cut open the storage cartridge, the at least one pointed and/or sharp-edged opening tab extending from the thermal resistor toward the flange, and wherein the at least one pointed and/or sharp-edged opening tab is configured to puncture and/or cut open the storage cartridge at a sealing foil when the mouthpiece and the heating device are brought into contact.

15. The vaporizer device according to claim 12, wherein an insulation foil covers at least the first contact tab and the second contact tab and extends in a direction towards a region of the flange on an inner surface of the hollow cylinder of the mouthpiece, wherein, in the region of the flange on the inner surface, the insulation foil includes at least two separated contact openings configured such that one of the at least two separated contact openings exposes the first contact tab and the other of the at least two separated contact openings exposes the second contact tab, wherein the two poles are two axially displaced rings, and wherein, in a connected condition of the mouthpiece, the heating device, and the voltage source, one of the two poles contacts the first contact tab via one of the at least two separated contact openings, and the other of the two poles contacts the second contact tab via the other of the at least two separated contact openings.

16. The vaporizer device according to claim 15, wherein the first contact tab and the second contact tab, and/or the region of the flange, include at least one locating groove and/or locating projection having a complementary counterpart at least one locating groove and/or locating projection on the first pole and the second pole of the voltage source, and wherein, in the connected condition of the mouthpiece, the heating device, and the voltage source, one of the at least one locating groove and/or locating projection on one pole of the two poles contacts a complementary counterpart one of the at least one locating groove and/or locating projection on the first contact tab via one of the at least two separated contact openings, and the other of the at least one locating groove and/or locating projection on the other pole of the two poles contacts a complementary counterpart other one of the at least one locating groove and/or locating projection on the second contact tab via the other of the at least two separated contact openings.

17. A vaporizer device for vaporizing a substance containing at least one active and/or aroma material, comprising:

a mouthpiece, having at least one fluid inlet and at least one fluid outlet; and a heating device, configured to be connected to the mouthpiece, comprising:

a thermal resistor comprising a metallic foil or a thin sheet in a shape of a dual coil and/or sinuous line, having two ends and dimensions substantially the same as a cross-section of a cigarette or a cigar, wherein interspaces of the shape are configured to allow a flow of fluid therethrough;

at least one contact tab including a first contact tab and a second contact tab being connected to respective opposed ends of the dual coil and/or sinuous line of the thermal resistor, the first contact tab and the second contact tab not being in direct contact with each other; and at least one vaporizer membrane disposed in contact with the thermal resistor and being permeable to the flow of fluid, and which is wetted or can be wetted with the substance containing the at least one active and/or aroma material, wherein the thermal resistor and the at least one vaporizer membrane are disposed perpendicular, to a direction of the flow of fluid across the thermal resistor and/or the at least one vaporizer membrane.

* * * * *